US009837197B2

(12) United States Patent
Irwin

(10) Patent No.: US 9,837,197 B2
(45) Date of Patent: Dec. 5, 2017

(54) LINEAR ACTUATOR

(71) Applicant: JOHNSON ELECTRIC S.A., Murten (CH)

(72) Inventor: James Irwin, Beavercreek, OH (US)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/923,551

(22) Filed: Oct. 27, 2015

(65) Prior Publication Data

US 2016/0125992 A1 May 5, 2016

Related U.S. Application Data

(60) Provisional application No. 62/073,140, filed on Oct. 31, 2014.

(51) Int. Cl.

| | |
|---|---|
| ***H01H 7/08*** | (2006.01) |
| ***H01F 7/08*** | (2006.01) |
| ***H01F 7/16*** | (2006.01) |

(52) U.S. Cl.

CPC ..... *H01F 7/088* (2013.01); *H01F 7/081* (2013.01); *H01F 7/1607* (2013.01); *H01F 2007/083* (2013.01)

(58) Field of Classification Search

CPC ..... H01F 7/124; H01F 7/088; H01F 7/081; H01F 7/1607; H01F 2007/083

USPC ..... 335/253

See application file for complete search history.

(56) References Cited

U.S. PATENT DOCUMENTS 3,683,239 A * 8/1972 Sturman ..... H01H 47/226 335/170
3,805,099 A * 4/1974 Kelly ..... H01F 7/1607 310/12.04
3,805,204 A * 4/1974 Petersen ..... H01F 7/1607 335/255

(Continued)

FOREIGN PATENT DOCUMENTS

DE 102008049915 A1 * 4/2010 ..... H01F 7/124
GB 1418606 A * 12/1975 ..... H01F 7/124

OTHER PUBLICATIONS

U.S. Appl. No. 15/610,135, filed May 31, 2017, entitled "Linear Actuators".

*Primary Examiner* — Shawki S Ismail
*Assistant Examiner* — Lisa Homza
(74) *Attorney, Agent, or Firm* — Nixon & Vanderhye P.C.

(57) ABSTRACT

A linear actuator (20, 20', 20") comprises a plunger receptacle (22); a coil (24); a magnetic plunger (26); a magnetic base (28); a return spring (30); and a lock spring (32, 32'). The coil (24) is wound about at least a portion of an exterior surface of the plunger receptacle (22). The magnetic plunger (26) is at least partially disposed within a cavity at least partially formed by an interior surface of the plunger receptacle (22) for linear motion along a plunger axis (34). The magnetic base (28) is radially disposed relative to the plunger (26). The return spring (30) is disposed to bias the plunger (26) to a plunger extended position. The lock spring (32, 32') is configured and oriented to lock the plunger (26) in the plunger extended position when power is not applied to the coil (24) but to be attracted to the magnetic base (28) and thereby permit movement of the plunger (26) to a plunger retracted position when the power is applied to the coil (24).

14 Claims, 10 Drawing Sheets

(56) References Cited

U.S. PATENT DOCUMENTS 3,806,850 A * 4/1974 McFarlin ..... H01H 50/20 335/203
4,327,344 A * 4/1982 Luckenbach ..... H01F 7/124 335/253
4,679,017 A * 7/1987 Mishler ..... H01F 7/124 251/129.03
4,697,164 A * 9/1987 Eilertsen ..... B60T 13/74 335/253
5,055,725 A * 10/1991 LaSota ..... H02K 7/06 310/12.27
5,261,637 A * 11/1993 Curnow ..... F16K 31/0668 251/129.02
5,467,962 A * 11/1995 Bircann ..... F02M 26/72 251/129.15
5,739,599 A * 4/1998 Murai ..... H01F 7/081 310/14
5,821,841 A * 10/1998 Furlani ..... H01F 7/1615 264/272.19
5,950,605 A * 9/1999 Hussey ..... H01F 7/1607 123/568.26
6,262,648 B1 * 7/2001 Lammers ..... H01F 7/122 335/177
6,486,762 B2 * 11/2002 Kurasawa ..... H01H 51/065 335/202
6,595,485 B2 * 7/2003 Burrola ..... F16K 31/0696 251/129.15
6,788,177 B1 * 9/2004 Weber ..... H01F 7/081 335/220
6,819,208 B1 * 11/2004 Peghaire ..... F01L 9/04 251/129.01
6,856,221 B1 * 2/2005 Zehrung ..... E05B 47/0002 335/220
6,940,373 B2 * 9/2005 Hintz ..... F03G 7/06 335/239
6,982,619 B2 * 1/2006 Nussio ..... F02M 59/366 335/262
7,315,230 B2 * 1/2008 Hoffman ..... H01F 7/1607 335/255
8,350,652 B2 * 1/2013 Hoppe ..... F01L 1/3442 310/12.31
2001/0023930 A1 * 9/2001 Kobayashi ..... B60T 8/363 251/129.14
2001/0032633 A1 * 10/2001 Bircann ..... H01F 7/1607 123/568.21
2002/0060620 A1 * 5/2002 Bircann ..... H01F 7/081 335/256
2008/0246569 A1 * 10/2008 Bogdon ..... H01H 50/22 335/256
2008/0297288 A1 * 12/2008 Irwin ..... H01F 7/1615 335/254
2010/0097165 A1 * 4/2010 Schilling ..... H01F 7/1615 335/257
2010/0123535 A1 * 5/2010 Yamagata ..... H01F 7/081 335/260
2011/0057753 A1 * 3/2011 Irwin ..... H01F 7/088 335/257
2012/0268225 A1 * 10/2012 Mahajan ..... H01F 7/1607 335/261
2013/0200966 A1 * 8/2013 Michaelsen ..... H01F 7/066 335/261
2015/0279538 A1 * 10/2015 Toda ..... H01F 7/081 475/31
2015/0279539 A1 * 10/2015 Blanding ..... H01F 7/123 335/228
2016/0196911 A1 * 7/2016 Comtois ..... H01F 7/081 335/256

* cited by examiner

LINEAR ACTUATOR

This application claims the priority and benefit of U.S. provisional Patent application 62/073,140 filed Oct. 30, 2014, which is incorporated herein by reference in its entirety.

TECHNICAL FIELD

The technology relates to linear actuators.

BACKGROUND

Linear actuators are employed in many and diverse environments. For many applications it is preferred that the linear actuator be unaffected by external shocks. A common method for limiting the effect of external mechanical shocks acting upon a linear actuator is to use a strong return spring that holds a plunger of the actuator in position up to a certain level of acceleration. Typically such strong return springs are either compression springs or conical springs. A major disadvantage of this strong return spring approach is that the strong return spring requires the actuator to have enough performance to overcome the return spring. The power necessary to achieve this spring-overcoming performance may be larger than necessary to move the actuator, and the larger power may in turn problematically increase heat in the actuator. An additional disadvantage is that these devices with higher return spring and actuation forces also have a significant increase in undesirable audible noise.

Some conventional actuators, represented by the actuator of FIG. 15, employ an internal lock spring, separate from the return spring, to stop against a ledge in the bobbin to prevent motion of the actuation pin (plunger) until power is supplied. Due to the short lever arm on the lock spring, the spring rate is higher in order to return the lock spring to the lock position. The actuator of FIG. 15 also involves closing air gap solenoid construction, where a base is axially in line with the actuation pin (plunger). With this construction, when the lock spring is actuated to the base, there is a frictional drag that needs to be overcome. As power increases, the plunger can be attracted to the base before the lock spring moves away from the lock position which would cause the unit to fail to actuate. Therefore extra power is needed to make sure the lock spring moves first. Since this type design utilizes a closing air gap and allows the plunger to contact the base, noise and residual magnetism are a concern. If the lock spring is made too weak, since it contacts the base, residual magnetism is of concern here as well. In addition, the residual magnetism concern also results in higher levels of return spring force being needed.

SUMMARY

The technology disclosed herein concerns a linear actuator comprising a plunger receptacle; a magnetic plunger; a magnetic base; and a lock spring. The magnetic plunger is at least partially disposed within a cavity at least partially formed by an interior surface of the plunger receptacle for linear motion along a plunger axis. The magnetic base is radially disposed relative to the plunger. The lock spring is configured and oriented to lock the plunger in a plunger extended position but to be attracted to the magnetic base when the plunger moves to a retracted position.

In an example embodiment and mode a coil is wound about at least a portion of an exterior surface of the plunger receptacle. The lock spring is configured and oriented to lock the plunger in the plunger extended position when power is not applied to the coil but to be attracted to the magnetic base and thereby permit movement of the plunger to the plunger retracted position when the power is applied to the coil.

In an example embodiment and mode the linear actuator further comprises an actuator frame comprising a frame aperture through which a plunger distal portion extends when the plunger is in the plunger extended position. The magnetic base serves to retain the plunger receptacle in position on the frame. That is, in an example embodiment and mode a portion of the actuator frame is secured to the magnetic base.

In an example embodiment and mode the magnetic base is disposed radially outside of an inner circumference of the plunger receptacle by an amount to reduce residual magnetism between the magnetic base and the lock spring.

In an example embodiment and mode the lock spring comprises a lock spring first end connected to the plunger and a lock spring second end. The lock spring second end is oriented to lock the plunger in the plunger extended position when power is not applied to the coil but to be attracted to the magnetic base and thereby permit movement of the plunger to the plunger retracted position when the power is applied to the coil.

In an example embodiment and mode the plunger receptacle comprises a plunger receptacle end wall. A return spring is disposed to bias the plunger to a plunger extended position. A first end of the return spring contacts the plunger receptacle end wall and a second end of the return spring bears against the plunger. The plunger receptacle end wall comprises a catch feature which engages the lock spring second end when the power is not applied to the coil.

In an example embodiment and mode the catch feature comprises a beveled surface which engages the lock spring second end.

In an example embodiment and mode the plunger receptacle end wall comprises an aperture configured to accommodate the lock spring second end when the lock spring second end is attracted to the magnetic base when the power is applied to the coil.

In an example embodiment and mode the lock spring comprises a lock spring first end connected to the plunger receptacle and a lock spring second end. The lock spring second end is oriented to lock the plunger in the plunger extended position when power is not applied to the coil but to be attracted to the magnetic base and thereby permit movement of the plunger to the plunger retracted position when the power is applied to the coil.

In an example embodiment and mode the plunger receptacle comprises a plunger receptacle end wall, wherein the lock spring first end is connected to the plunger receptacle end wall and wherein the lock spring second end contacts a plunger lock spring catch which is connected to or comprises the plunger when power is not applied to the coil.

In an example embodiment and mode, the plunger receptacle comprises a plunger receptacle end wall, wherein a lock spring first end is connected to the plunger receptacle end wall and a lock spring second end contacts a plunger lock spring catch when power is not applied to the coil. The plunger lock spring catch is preferably formed on a non-magnetic portion of the plunger, e.g., a plunger non-magnetic collar. The lock spring second end and the plunger (including the plunger non-magnetic collar) are configured and positioned such that, after the second end of the lock spring has been attracted to the base and has released the plunger for motion, the second end of lock spring is again attracted to the plunger to reduce the hold power of the retracted position.

BRIEF DESCRIPTION OF THE DRAWINGS

The foregoing and other objects, features, and advantages of the technology disclosed herein will be apparent from the following more particular description of preferred embodiments as illustrated in the accompanying drawings in which reference characters refer to the same parts throughout the various views. The drawings are not necessarily to scale, emphasis instead being placed upon illustrating the principles of the technology disclosed herein.

FIG. 9A does not show enough space between the plunger and the plunger cavity to allow the lock spring to fit so the plunger can retract.

DETAILED DESCRIPTION

In the following description, for purposes of explanation and not limitation, specific details are set forth such as particular architectures, interfaces, techniques, etc. in order to provide a thorough understanding of the technology disclosed herein. However, it will be apparent to those skilled in the art that the technology disclosed herein may be practiced in other embodiments that depart from these specific details. That is, those skilled in the art will be able to devise various arrangements which, although not explicitly described or shown herein, embody the principles of the technology disclosed herein and are included within its spirit and scope. In some instances, detailed descriptions of well-known devices, circuits, and methods are omitted so as not to obscure the description of the technology disclosed herein with unnecessary detail. All statements herein reciting principles, aspects, and embodiments of the technology disclosed herein, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
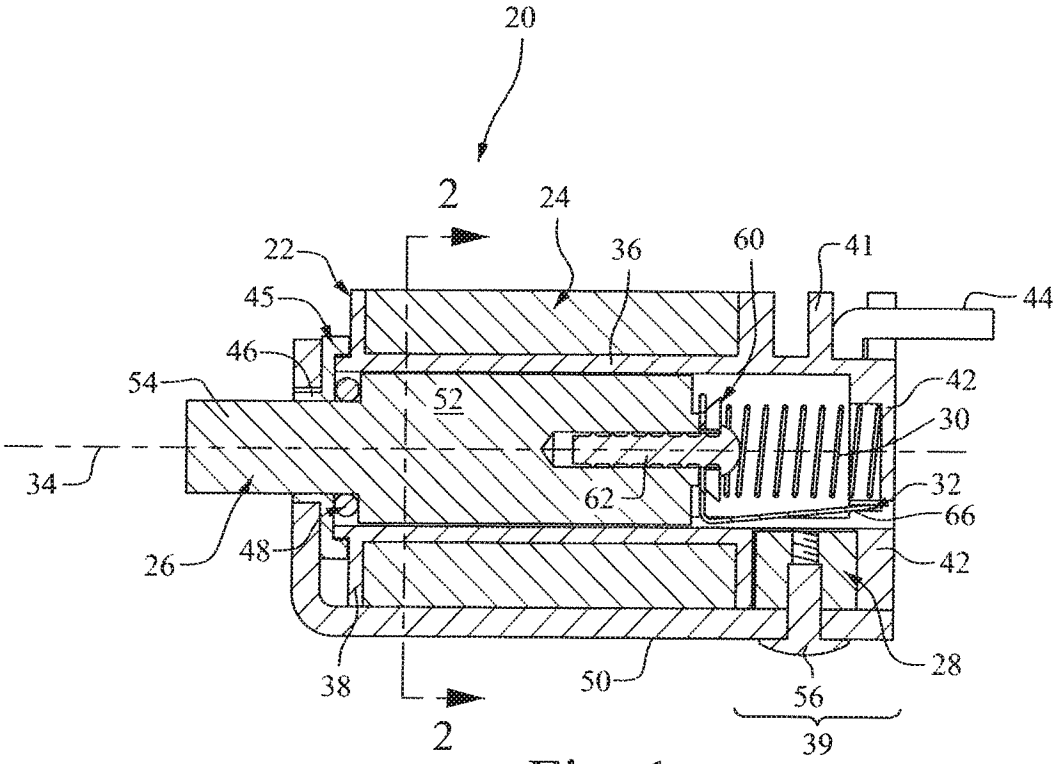
FIG. 1 is a side sectioned view of a linear actuator according to a first example embodiment, showing the linear actuator with plunger extended operation.
Figure 8:
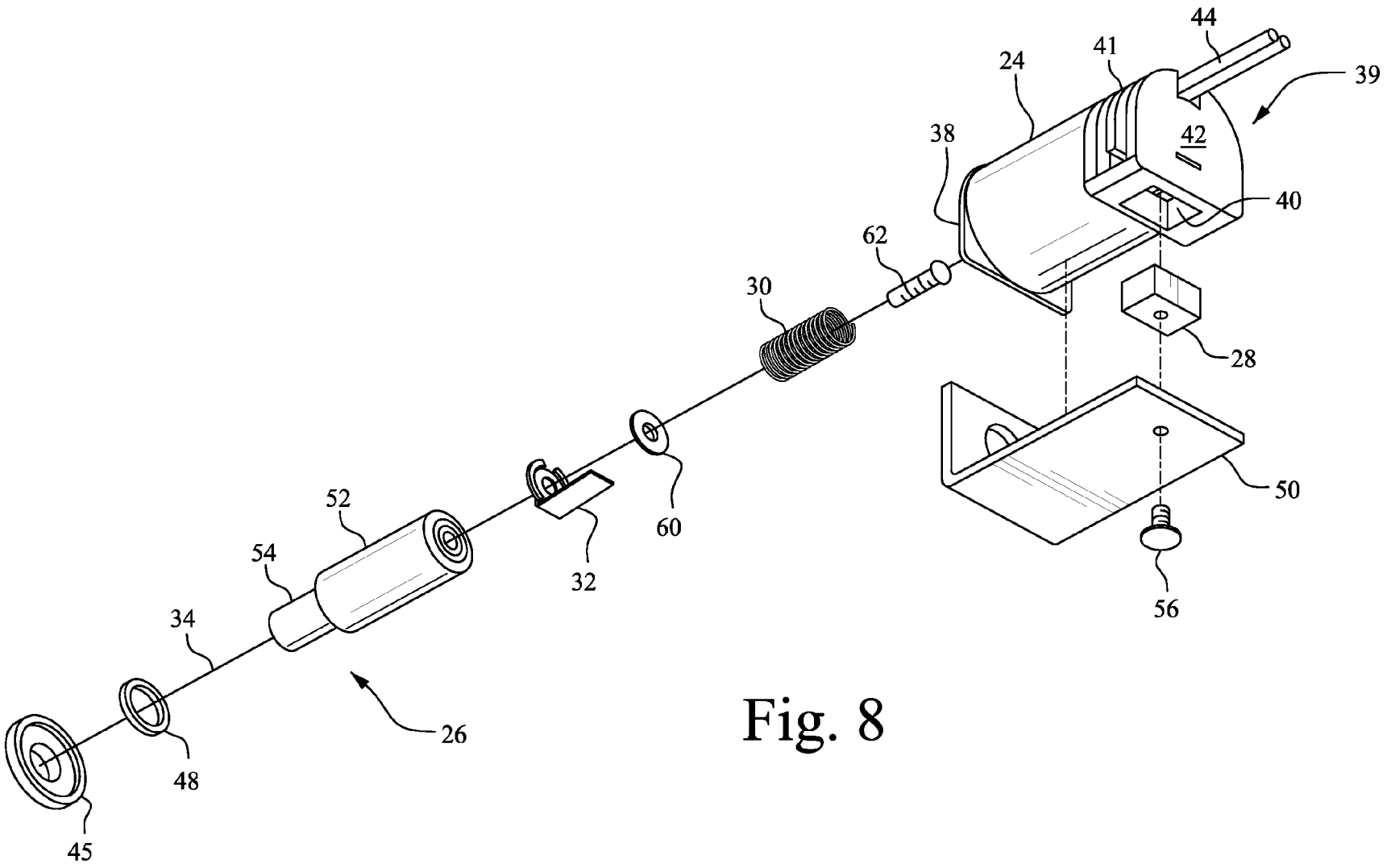
FIG. 8 is an exploded view of the linear actuator of FIG. 1.

FIG. 1-FIG. 8 show a linear actuator 20 according to an example embodiment. FIG. 1 particular shows linear actuator 20 in a plunger-extended operational mode. As shown in FIG. 1 and FIG. 8, linear actuator 20 comprises plunger receptacle 22; coil 24; plunger 26; magnetic base 28; return spring 30; and lock spring 32. The plunger 26 extends and reciprocates along plunger axis 34 between a plunger-extended operational mode/position (shown in FIG. 1) when electrical power is not applied to coil 24 and a plunger-retracted mode/position (shown in FIG. 3) when power is applied to coil 24. The plunger 26, magnetic base 28, and lock spring 32 are ferromagnetic.

The plunger receptacle 22 comprises cylindrical wall 36 which is essentially centered about plunger axis 34. The cylindrical wall 36 has an exterior surface and an interior surface. The interior surface of cylindrical wall 36 defines a cavity in which a portion of plunger 26 is disposed. As shown in FIG. 8, plunger receptacle 22 comprises distal end wall 38 and proximal end wall section 39. Top portions of both distal end wall 38 and proximal end wall section 39 are curved in a manner to be essentially concentric with cylindrical wall 36. However, bottom portions of both distal end wall 38 and proximal end wall section 39 are essentially rectangular so that they may be positioned on a flat surface of a frame. As such, distal end wall 38 and proximal end wall section 39 may each be viewed as having a "D" shape, lying on a flat leg of the D. The proximal end wall section 39 has greater extent along the axis 34 than the distal end wall 38. The proximal end wall section 39 is dimensioned along axis 34 in order to include rectangular volume shaped aperture 40 into which base 28 may fit. On its top, the proximal end wall section 39 comprises plural radially extending flanges, including two radially extending flanges which define a segment of cylindrical wall 36 between which coil 24 is wound. In addition, the exterior surface of cylindrical wall 36 comprises coil lead wire-retaining flange 41.

The plunger receptacle 22 also comprises plunger receptacle end wall 42. An interior surface of plunger receptacle end wall 42 may also at least partially define the cavity which accommodates portions of plunger 26. A portion of plunger receptacle end wall 42 extends radially and parallel to lead wire-retaining flange 41, so that coil lead wire 44 is retained between plunger receptacle end wall 42 and lead wire-retaining flange 41. The coil lead wire 44 is connected to an unillustrated power source which is selectively operated, e.g. by a controller or the like, to supply power to coil 24

The plunger receptacle cylindrical wall 36, or a portion of plunger receptacle cylindrical wall 36, which has coil 24 wound about, may also be considered a bobbin. In some embodiments the plunger receptacle cylindrical wall 36 and the plunger receptacle end wall 42 may be integral and thus essentially form a one piece plunger receptacle 22. However, in other embodiments the plunger receptacle end wall 42 may be a different piece of same or similar material which is connected to plunger receptacle cylindrical wall 36. The plunger receptacle 22, comprising its plunger receptacle cylindrical wall 36, distal end wall 38, and proximal end wall section 39, together with coil 24 wound around plunger receptacle cylindrical wall 36, may also be considered a coil assembly, Opposite its plunger receptacle end wall 42 the plunger receptacle end wall 22 is partially enclosed by plunger receptacle cap 45. The plunger receptacle cap 45 has a central aperture defined by plunger receptacle cap neck 46 centered on plunger axis 34. An O-ring 48 or other resilient cushion member is positioned between an inside surface of plunger receptacle cap 45 and plunger 26. The plunger receptacle cap neck 46 fits through an aperture in actuator frame 50. In the particular illustration of FIG. 1 the actuator frame 50 is shown as having essentially an L-shape, although other shapes and configurations are also possible depending on manner of employment and installation of linear actuator 20 with respect to the environmental structure for intended use. In a preferred embodiment, actuator frame 50 is preferably ferromagnetic for improving efficiency, although in other embodiments a non-ferromagnetic frame 50 may be utilized.

Figure 2:
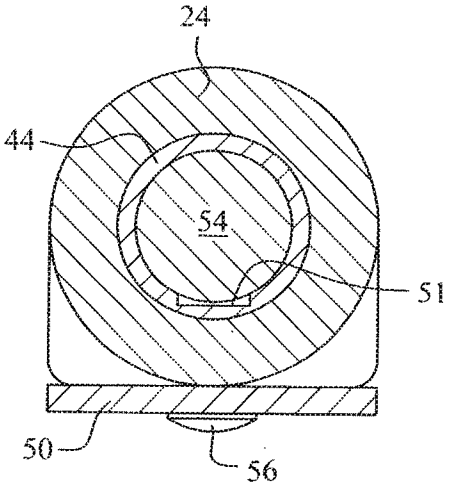
FIG. 2 is a left end view taken along line 2-2 of FIG. 1.

As seen in FIG. 2, a lower interior surface of plunger receptacle cylindrical wall 36 comprises lock spring groove or trough 51 formed therein. The lock spring groove 51 comprises an essentially flat bottom and extends parallel to axis 34 for essentially the entire length of plunger receptacle cylindrical wall 36. The lock spring groove 51 is configured to accommodate lock spring 32 and to allow lock spring 32 to ride in lock spring groove 51. Placement and positioning of the lock spring 32 in lock spring groove 51 aligns the lock spring 32 with magnetic base 28 and with a catch feature 70 (see FIG. 6), and also limits rotation of plunger 26.

Figure 3:
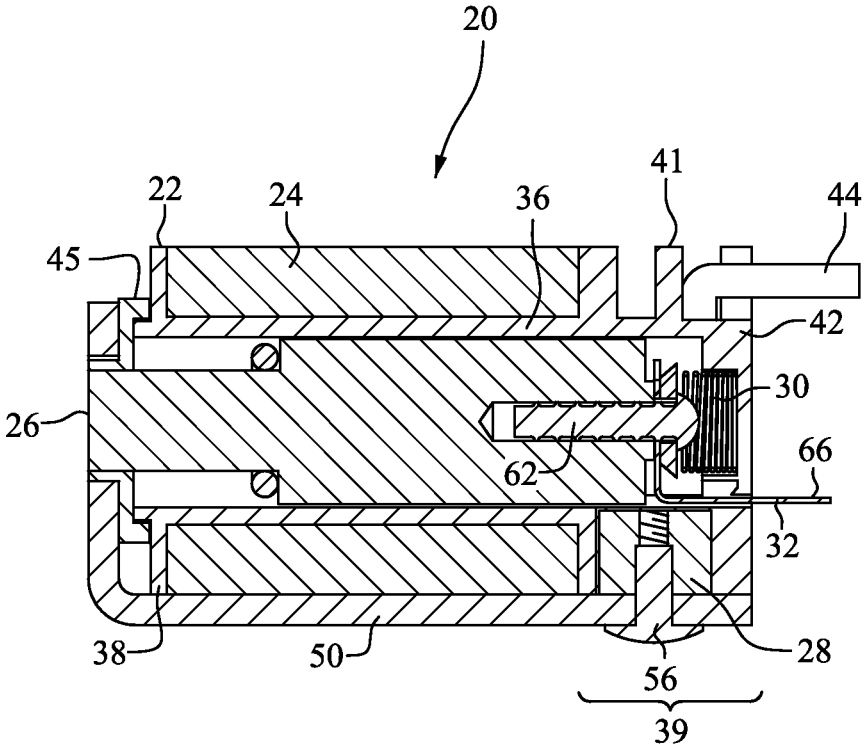
FIG. 3 is a side sectioned view of a linear actuator according of FIG. 1 showing the linear actuator with plunger retracted operation.

The plunger 26 comprises plunger main portion 52 and plunger distal portion 54. At least a portion of plunger 26 is ferromagnetic. For example, in an example embodiment at least a portion of plunger 26 is a natural magnet (e.g., a permanent magnet). In one example embodiment the entire plunger 26 may be magnetic. The plunger main portion 52 is essentially confined with the cavity defined by plunger receptacle cylindrical wall 36, and has a larger diameter than plunger distal portion 54. At least a portion of plunger distal portion 54 extends through the plunger receptacle cap neck 46 and through an aperture provided in actuator frame 50. The degree of protrusion of plunger distal portion 54 from the actuator frame 50 depends on whether the plunger 26 is in the plunger extended operational mode (as shown in FIG. 1) or the plunger retracted operational mode (as shown in FIG. 3). In the plunger retracted operational mode very little, if any, of the plunger distal portion 54 may extend through the actuator frame 50.

The magnetic base 28 is disposed radially with respect to outside of a circumference of plunger 26. In other words, magnetic base 28 is positioned outside of a circumference of plunger 26, and is not axially aligned with plunger 26. As such, no part of magnetic base 28 lies along plunger axis 34. Moreover, as shown in FIG. 1, "outside of a circumference of plunger 26" refers to the fact that the magnetic base 28 is radially exterior to the imaginary extensions of cylindrical sidewalls of plunger 26 along an axis parallel to axis 34. In the illustrated example embodiment the magnetic base 28 is radially disposed through a portion of cylindrical wall 36 near but slightly spaced away from plunger receptacle end wall 42. In an example embodiment the magnetic base 28 has essentially the shape of a rectangular prism and is sized to fit into rectangular volume shaped aperture 40. The rectangular volume shaped aperture 40 is provided on a bottom surface of plunger receptacle proximal end wall section 39. After the magnetic base 28 is inserted into aperture 40, the plunger receptacle proximal end wall section 39 is underlaid by frame 50. The frame 50 has a hole which is aligned with a threaded screw hole of magnetic base 28. Frame 50 fits over plunger receptacle cap 45 and is positioned under proximal end wall section 39. When the frame hole and hole in the magnetic base 28 are aligned, a threaded shank of fastening screw 56 is inserted into the threaded screw hole and tightened. When the fastening screw 56 is inserted into the threaded hole in magnetic base 28, the plunger receptacle 22 is captured in frame 50 by bobbin cap neck 46 and wedged between frame 50 and the magnetic base 28. As shown, e.g., in FIG. 8, the actuator frame 50 comprises a frame aperture through which plunger distal portion 54 extends when the plunger 26 is in the plunger extended position, and the magnetic base 28 serves to retain the plunger receptacle 22 in position (e.g., in axial position along axis 34) on the frame 50. Thus, in an example embodiment and mode a portion of the actuator frame is secured to the magnetic base 28 via fastening screw 56.

The return spring 30 is disposed to bias the plunger 26 to its plunger extended position. Preferably the return spring 30 is a coiled compression spring. A first end of the return spring 30 contacts and is retained by (and may be connected to) an interior surface of plunger receptacle end wall 42. A second end of the return spring 30 bears against the plunger 26. In particular, the second end of return spring 30 bears against return spring support member 60. The return spring support member 60 is a washer-type structure which is captured under a head of plunger drive pin 62. The plunger drive pin 62 has a shaft which extends into a central aperture of plunger main portion 52. The plunger drive pin 62 thus secured by interference between the drive pin and the plunger aperture along plunger axis 34 of plunger 26. The return spring support member 60 also serves to secure, between itself and plunger main portion 52, a first or proximal end of lock spring 32, e.g., lock spring proximal end 64. The return spring 30 thus serves not only to bias the plunger 26 to its plunger extended position, but to exert a force on and move an entire plunger assembly (comprising plunger 26, lock spring 32, return spring support member 60, and drive pin 62) to the biased position. The return spring 30 thus serves to move the lock spring 32 leftward (as depicted in FIG. 1) along the direction of axis 34 after cessation of application of power to coil 24, so that the lock spring 32 can regain position to perform its locking role.

The lock spring 32 is configured and oriented to lock the plunger 26 in a plunger extended position when power is not applied to the coil 24. But lock spring 32 is also configured and oriented to be attracted to the magnetic base 28 (e.g., into lock spring groove or trough 51) and thereby permit movement of the plunger 26 to a plunger retracted position when the power is applied to the coil 24. Different embodiments and configurations of lock spring 32 are described herein, with some embodiments differing by reason of, e.g., location at which a first end of the lock spring 32 is anchored or connected in a position and/or manner in which a second end of the lock spring permits movement of plunger 26

(when the coil 24 is activated) or alternatively limits movement or prevents full movement of the plunger.

In a first example embodiment shown in FIG. 1 through FIG. 8, the lock spring 32 has its lock spring first end 64 (proximal end) connected to the plunger 26. A second or distal end of the lock spring (lock spring distal end 66) is oriented to lock the plunger 26 in the plunger extended position shown in FIG. 1 when power is not applied to coil 24. On the other hand, as shown in FIG. 3, the lock spring distal end 66 is oriented and configured to be attracted to the magnetic base 28 (e.g., into lock spring groove or trough 51) and thereby permit movement of the plunger 26 to its plunger retracted position when the power is applied to the coil 24.

Figure 4:
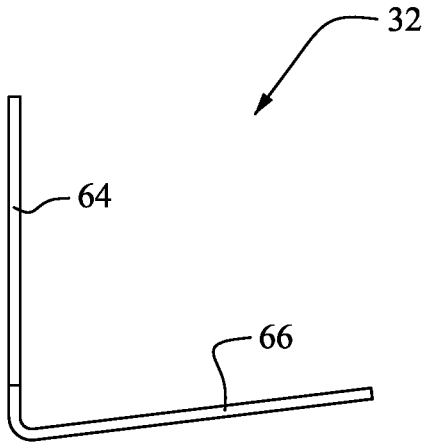
FIG. 4 and FIG. 5 are side and right end view of a lock spring according to an example embodiment.

As seen in FIG. 1 and enlarged in FIG. 4, in a side profile the lock spring 32 appears to comprise two linear segments, one of which comprises lock spring proximal end 64 and the other of which comprises lock spring distal end 66. In the side profile the two segments of lock spring 32 appear to impart an almost L-shape to lock spring 32. The shape of lock spring 32 is said to be "almost L-shape" in the sense that an interior angle between the two segments is on the order of 84°+3°/−0°. When the magnetic field is imposed the lock spring 32 deflects such that lock spring distal end 66 is parallel with the centerline (e.g., axis 34), e.g., deflects so that the interior angle between the two segments is at least substantially 90° so that the distal end 66 is essentially parallel to the direction of plunger 22 movement The lock spring distal end 66 is resilient to the extent that lock spring distal end 66 can assume a greater interior angle with respect to lock spring proximal end 64, e.g., ninety degrees or more, when lock spring distal end 66 is attracted to magnetic base 28 upon activation of coil 24 (e.g., upon application of power to coil 24).

Figure 5:
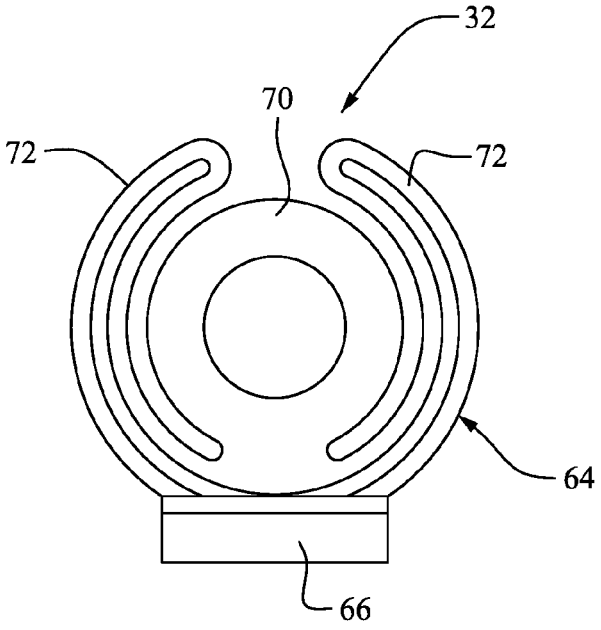

The configuration of lock spring proximal end 64 in an example embodiment is seen from a right end view of linear actuator 20 as illustrated in FIG. 5. As shown in FIG. 5, lock spring proximal end 64 comprises a circular-shaped central member 76 which is surrounded in a same plane by two almost half circular arms 72 through which central member 76 is attached to the segment of lock spring 32 that terminates in lock spring distal end 66. Each of the arms 72 comprise two semicircular segments separated by an arc-shaped gap, and outside segment of the two segments of each arm 72 being at a further radial position from an axial center of lock spring proximal end 64 than the inner segment. At it periphery the central member 70 is connected to distal ends of the inner segments of both half circular arms 72. At their farthest extent from attachment to central member 76 both inner segments of half circular arms 72 take a 180 degree bend to join with the outer segments of their respective half circular arm 72. A proximal end of the outer segment of each half circular arm 72 is connected to lock spring distal end 66.

In general, the spring rate of a cantilever (e.g., beam) is inversely proportional to the cube of the length of the cantilever. The configuration of the lock spring 32 as shown in FIG. 5 defines the length of the cantilever of the lock spring 32 to be a sum of the length of the semicircular inner segments and the semicircular outer segments of the half circular arms 72. With this configuration the lock spring 32 has a low spring rate (e.g., a low force requirement to deflect and unlock.

Figure 6:
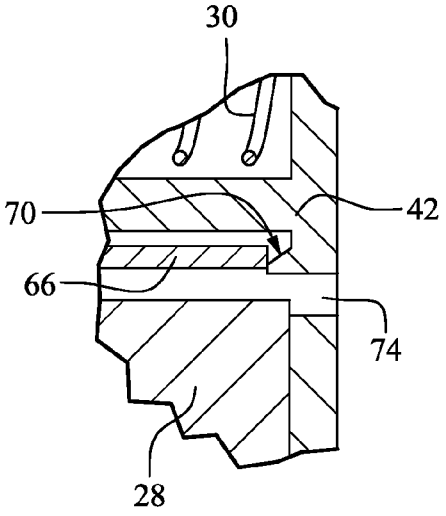
FIG. 6 is an enlarged view of a portion of the linear actuator of FIG. 1, particularly showing a lock spring when in the actuator is in a plunger extended position
Figure 7:
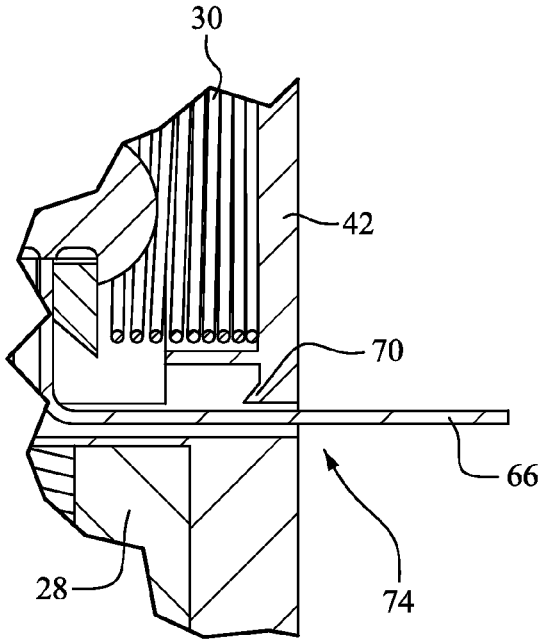
FIG. 7 is an enlarged view of a portion of the linear actuator of FIG. 1, particularly showing a lock spring when in the actuator is in a plunger retracted position.

As shown in FIG. 1 and in more detail in FIG. 6, plunger receptacle end wall 42 comprises catch feature 70 which engages lock spring distal end 66 when the power is not applied to the coil 24. The catch feature 70 comprises a finger which extends essentially perpendicularly from plunger receptacle end wall 42 along the direction of plunger axis 34 and which comprises a beveled surface which engages or "hooks" lock spring distal end 66 when power is not applied to coil 24. The catch feature 70 may be integral with plunger receptacle end wall 42, or may be a separate cantilevered or other appropriate member which is mounted or otherwise secured to plunger receptacle end wall 42.

A second example embodiment of a linear actuator 20' is shown in FIG. 9A-FIG. 9B, FIG. 10A-FIG. 10B, and FIG. 11A-FIG. 11B. The linear actuator 20' is similar to the actuator 20 of FIG. 1, and primarily differs in the manner of attachment and orientation of lock spring 32'. For example, lock spring 32' comprises lock spring first or proximal end 64' connected to the plunger receptacle 22 and lock spring second or distal end 66'. As seen from a side profile view of FIG. 9A, FIG. 10A, and FIG. 11A, lock spring 32' has an essentially "L" shaped configuration, similar to that of lock spring 32 of FIG. 1, but is differently oriented with respect to the direction of axis 34. Both the lock spring proximal end 64' and lock spring distal end 66' are resilient.

Lock spring proximal end 64' extends in a plane orthogonal to axis 34. In that orthogonal plane the lock spring proximal end 64' may have a circular shape with a central circular aperture. The central circular aperture of lock spring proximal end 64' may fit over a central hub 80 formed on or mounted to an interior surface of plunger receptacle proximal side wall 24. The central hub 80 protrudes into the plunger cavity. Near its distal end central hub 80 comprises a spring mounting rim 81 against which an end of the return spring 30 bears. Intermediate the spring mounting rim 81 and the interior surface of plunger receptacle right side wall 24 the central hub 80 comprises hub circumferential groove 82. An interior surface of the central circular aperture of lock spring proximal end 64' fits over central hub 80 and lodges in hub circumferential groove 82.

Figure 9B:
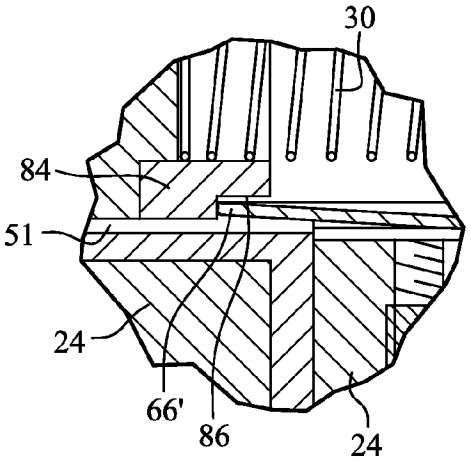
FIG. 9B is an enlarged view of a portion of the plunger-extended linear actuator of FIG. 9A.
Figure 9A:
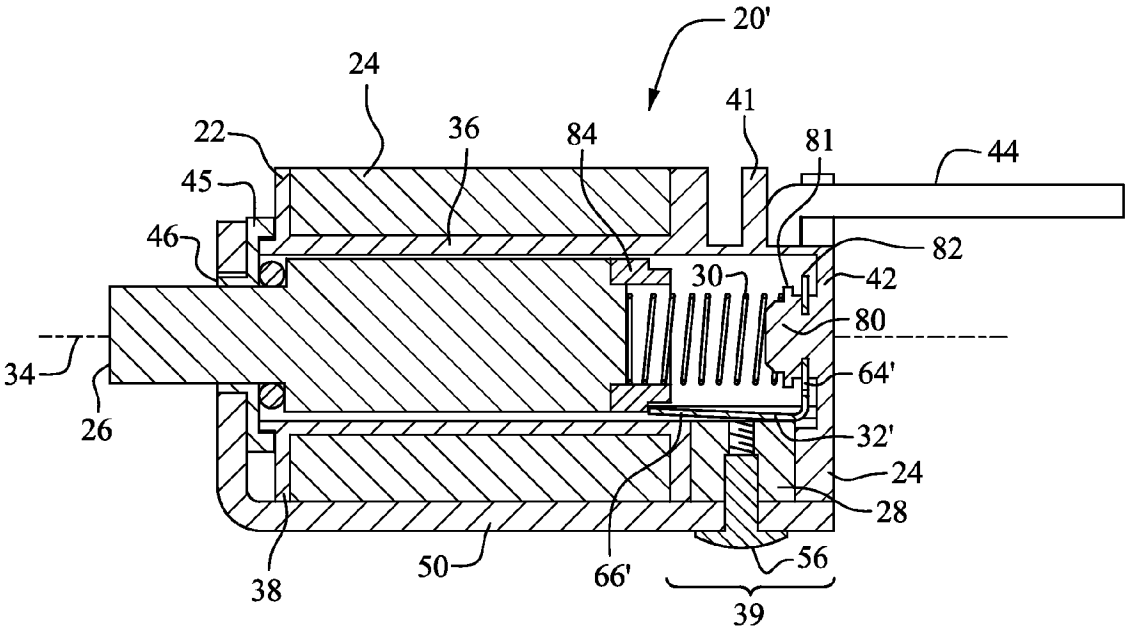
FIG. 9A is a side sectioned view of a linear actuator according to a second example embodiment, showing the linear actuator with plunger extended operation.

The plunger 26 of the second embodiment actuator 20' comprises plunger non-magnetic collar 84. The plunger non-magnetic collar 84 has the shape of a hollow cylinder. A hollow center of the plunger non-magnetic collar 84 accommodates an end of the return spring 30 and thus forms the non-working end of plunger 26. As shown in the enlarged view of FIG. 9B, FIG. 10B, and FIG. 11B, an outer peripheral surface of plunger non-magnetic collar 84 is stepped or notched to provide plunger lock spring catch 86. The plunger lock spring catch 86 is oriented to lock the plunger 26 in the plunger extended position (shown in FIG. 9A and FIG. 9B) when power is not applied to coil 24. When plunger 26 is in its plunger extended position as shown in FIG. 9A and FIG. 9B, a tip of lock spring distal end 66' is biased to engage the plunger lock spring catch 86 and thereby limit axial displacement of the plunger 26 toward the plunger retracted position.

Figure 10B:
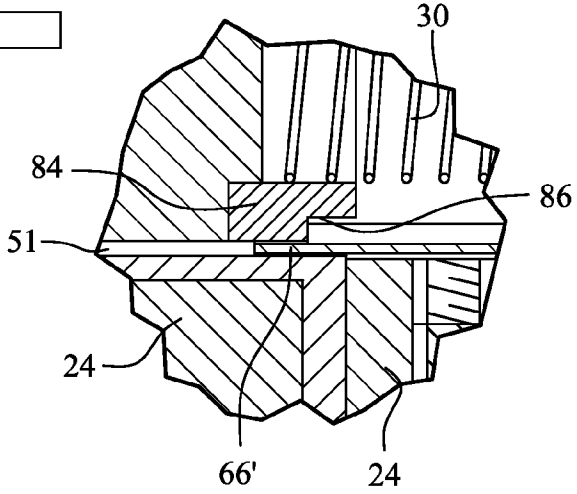
FIG. 10B is an enlarged view of a portion of the plunger semi-retracted linear actuator of FIG. 10A.

As electrical power is applied to coil 24, the lock spring 32' is attracted into lock spring groove 51 toward magnetic base 28, thereby enabling the plunger 26 to start to move from its fully extended position (shown in FIG. 9A and FIG. 9B) to a semi-retracted plunger position (shown generally in FIG. 1 OA and shown in more detail in FIG. 10B). Attraction of the lock spring 32 to magnetic base 28 causes the tip of lock spring distal end 66' to displace radially into lock spring groove or trough 51 and therefore no longer bear against plunger lock spring catch 86. The configuration and orientation of lock spring distal end 66' is thus such that, when power is applied to coil 24, lock spring distal end 66' is attracted to the magnetic base 28 (e.g., into lock spring groove or trough 51) and thereby permits movement of the plunger 26, first to the plunger semi-retracted position (shown generally in FIG. 1 OA and shown in more detail in FIG. 10B).

With continued application of power to coil 24, the plunger 26 continues to retract so that a magnetic portion of plunger 26 (rather than plunger non-magnetic collar 84) is in radial proximity to the magnetic base 28. With such continued retraction the lock spring distal end 66' is attracted to a peripheral surface of the magnetic portion of plunger 26. In the case where the lock spring 32' is flat and the plunger 26 is a cylinder, there is only line contact between plunger 26 and lock spring 32', which line contact imparts only a minimal amount of friction. However, since the magnetic force on the plunger 26 is increasing with position change, the friction only acts to slow the speed of plunger 26 as opposed to stopping motion. The advantage of this phenomena is exploited by realizing that this friction may be used to increase the holding force and thus reduce the overall power consumption and heating.

The plunger non-magnetic collar 84 serves not only to provide situs of plunger lock spring catch 86, but also to dampen flux at the innermost end of plunger 26 so that the magnetic force of plunger 26 does not overpower the attracting force of magnetic base 28 on lock spring 32' when it is desired to unlock or move the plunger 26.

Figure 10A:
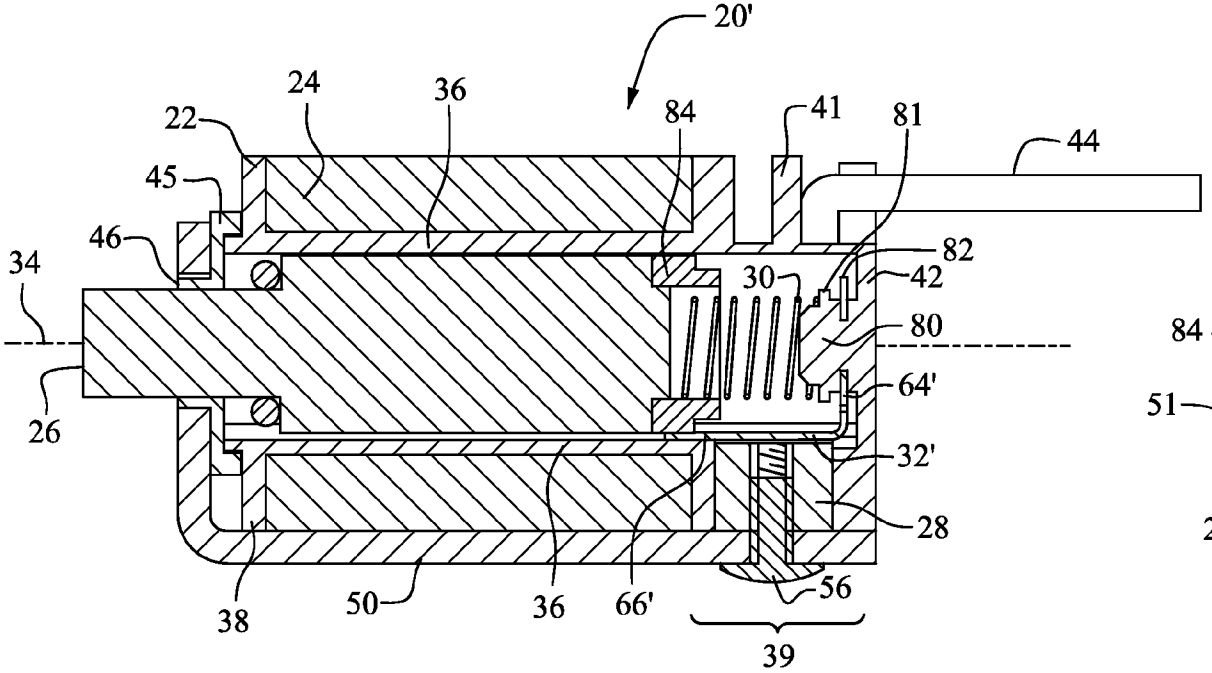
FIG. 10A is a side sectioned view of the linear actuator according of FIG. 9A showing the linear actuator with plunger semi-retracted operation.
Figure 11B:
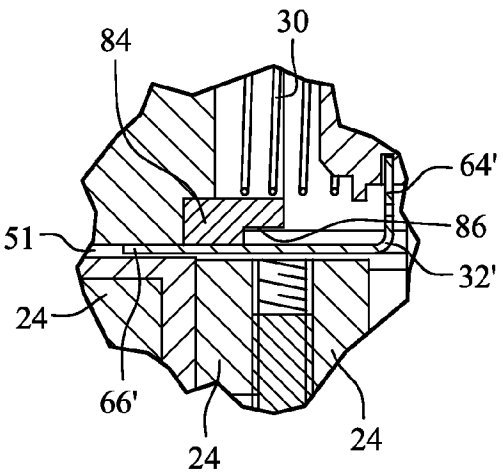
FIG. 11B is an enlarged view of a portion of the plunger fully retracted linear actuator of FIG. 11A.
Figure 11A:
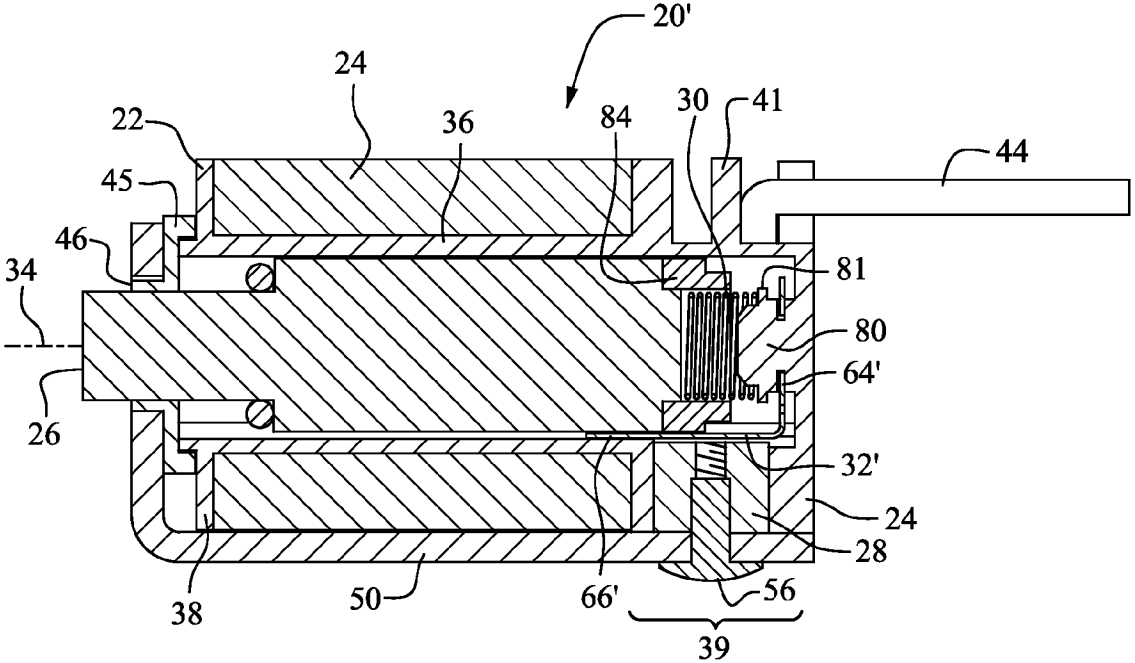
FIG. 11A is a side sectioned view of the linear actuator according of FIG. 9A showing the linear actuator with plunger fully retracted operation.

Thus, plunger receptacle 26 comprises a plunger receptacle end wall 42, wherein the lock spring first end 64' is connected to the plunger receptacle end wall 42 and wherein the lock spring second end 66' contacts a plunger lock spring catch 86 when power is not applied to the coil 24. The plunger lock spring catch 86 is preferably formed on a non-magnetic portion of the plunger, e.g., the plunger non-magnetic collar 84. The lock spring second end 66' and the plunger 26 (including plunger non-magnetic collar 84) are configured and positioned such that, after lock spring second end 66' has been attracted to the base and has released the plunger for motion (as shown in FIG. 10A and FIG. 10B), the second end 66' of lock spring 32' is again attracted to the plunger 26 (as shown in FIG. 11A and FIG. 11B) to reduce the hold power of the retracted position.

Thus, in the second embodiment of FIG. 9A, FIG. 9B, FIG. 10A, FIG. 10B, FIG. 11A, and FIG. 11B, the point of attachment and orientation of the lock spring is essentially the reverse of the first embodiment of FIG. 1-FIG. 8. In the second embodiment, even though there may be magnetic attraction from the plunger 26 to the lock spring 32', the force from the magnetic base 28 will be greater and cause the lock spring 32' to move into lock spring groove or trough 51 so the plunger 26 may move to the energized or retracted position.

Figure 12:
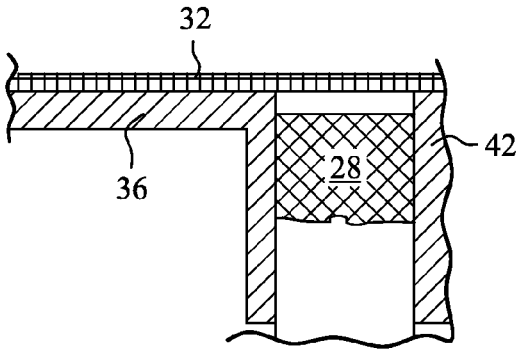
FIG. 12 is a sectioned partial side view showing sub-flush positioning of a magnetic base relative to a plunger receptacle surface.

FIG. 12 shows in enlarged fashion that a plunger-nearest surface of magnetic base 28 lies at a further radial position (with respect to axis 34) than does the interior surface of plunger receptacle cylindrical wall 36. That is, the magnetic base 28 is essentially "subflush" with respect to or radially spaced away from lock spring groove or trough 51 into which the lock spring proximal end 64 is drawn when coil 24 is energized (coil 24 is energized in FIG. 12). As a result, there is no residual magnetism in the spring-to-base interface (e.g., an interface of lock spring 32 and magnetic base 28) and the lock spring 32 rides on low-coefficient of friction material (e.g., a low coefficient of friction plastic material) which contributes to lower energizing power. That is, the magnetic base 28 is disposed radially outside of an inner circumference of the plunger receptacle wall 36 by an amount to reduce the residual magnetism between the magnetic base 28 and the lock spring 32. Moreover, if an attempt were made to move the plunger 26 without powering coil 24, a flexible part of the lock spring 32 allows plunger 26 to hit against the lock spring 32 such that the distal end of the lock spring is loaded as a column. Whereas if the prior art were to have a spring rate for attempting to reduce power, the column strength of the prior art would be compromised, which could cause a permanent deflection and a failure to function. In other words, if the prior art were to lower its spring rate, the spring material would be much thinner and therefore more susceptible to buckling due to reduced columnar strength.

FIG. 12 thus describes at least a portion of the retracted plunger operation of the linear actuator 20 of the first embodiment of FIG. 1, and at least the semi-retracted plunger operation (see, e.g., FIG. 10A and FIG. 10B) of the linear actuator 20' of the second embodiment.

Figure 13:
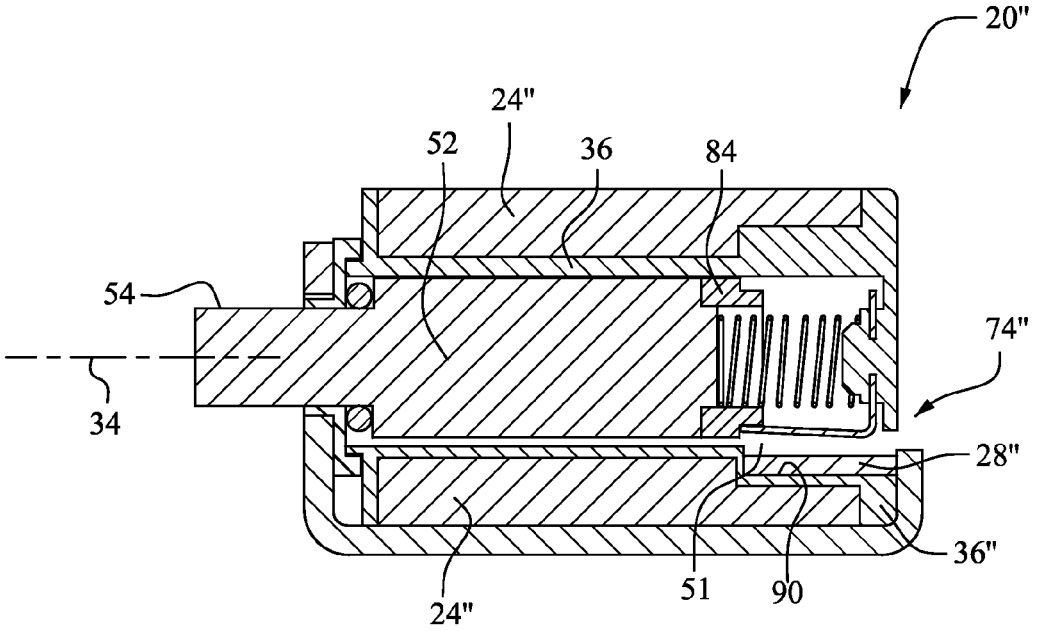
FIG. 13 is a side sectioned view of a linear actuator according to a third example embodiment, showing the linear actuator with plunger retracted operation.
Figure 14:
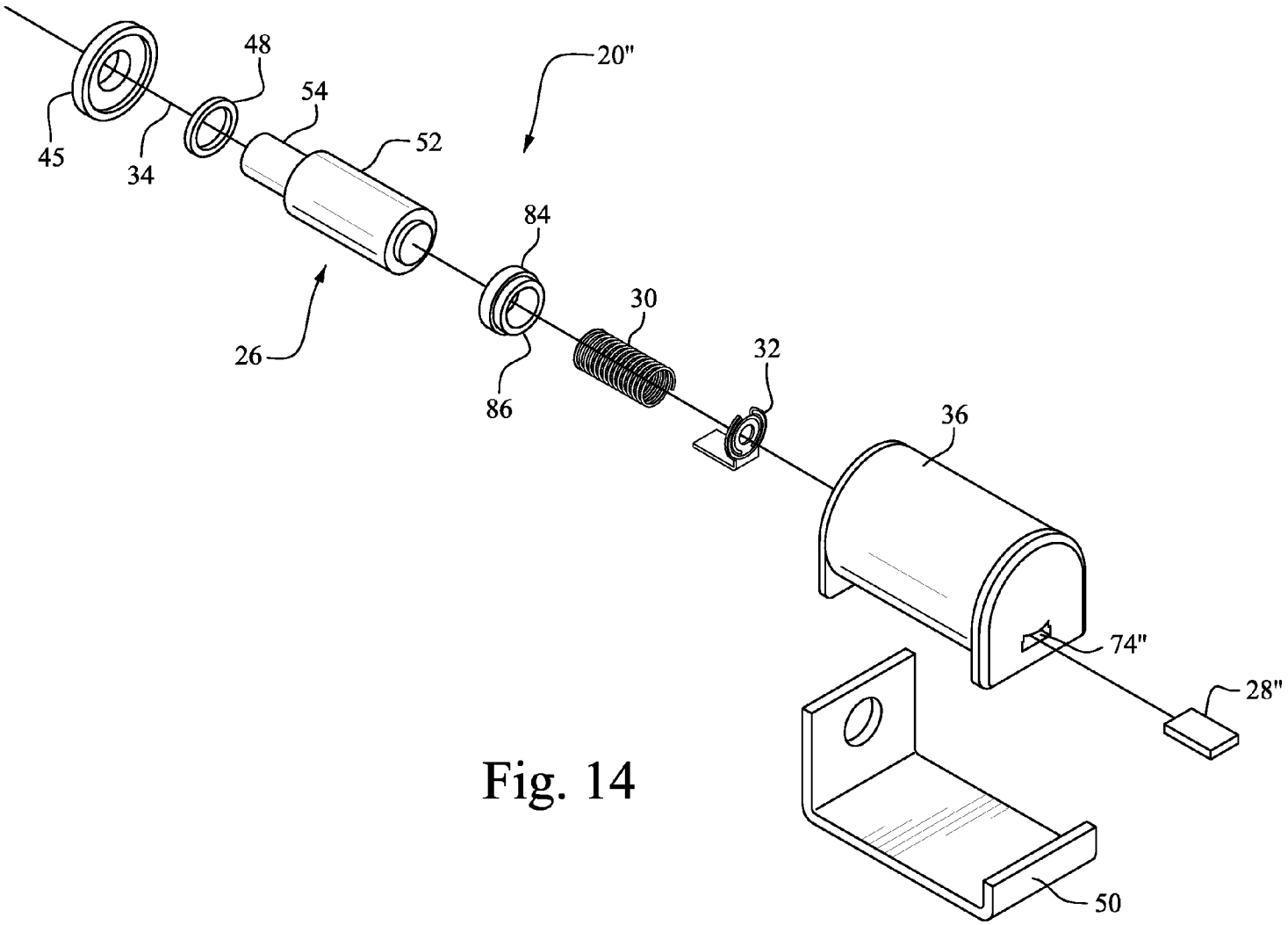
FIG. 14 is an exploded view of the linear actuator of FIG. 13.

FIG. 13 and FIG. 14 illustrate a third example embodiment of a linear actuator 20". Elements of the third embodiment linear actuator 20" which are similar to those of the earlier embodiments are similarly numbered. The lock spring 32 of the linear actuator 20" of FIG. 13 and FIG. 14 is oriented and positioned similarly to the second embodiment. However, for the third embodiment linear actuator 20" the magnetic base 28" is inserted axially rather than radially. That is, for third embodiment linear actuator 20" the magnetic base 28" is inserted in a direction parallel to axis 34 through bobbin end wall aperture 74" (see FIG. 14). After insertion, the magnetic base 28" lies on a recessed interior surface 90 of plunger receptacle cylindrical wall 36." The recessed interior surface 90 is radially positioned with respect to axis 34 so that the magnetic base 28" of the third example embodiment also lies essentially "subflush" with respect to or radially spaced away from lock spring groove or trough 51 (e.g., the groove or trough into which the lock spring proximal end 64 is drawn when coil 24 is energized), in the same manner as explained above with reference to FIG. 12. In this regard, in one example implementation the bobbin end wall aperture 74" may lie essentially parallel with recessed interior surface 90. In another example implementation, the bobbin end wall aperture 74" may be positioned above or radially closer to axis 34 so that the magnetic base 28" sinks radially to lie on the recessed interior surface 90 of plunger receptacle cylindrical wall 36". As with the other example embodiments, magnetic base 28" is radially disposed relative to the plunger. Further, in the third embodiment of FIG. 13 and FIG. 14 the coil 24" does not have uniform radial thickness, since along axis 34 in the vicinity of the magnetic base 28" the radial thickness of the coil is less than the nominal coil thickness along the remainder of axis 34, due to the formation of the recessed interior surface 90 of plunger receptacle cylindrical wall 36".

Figure 15:
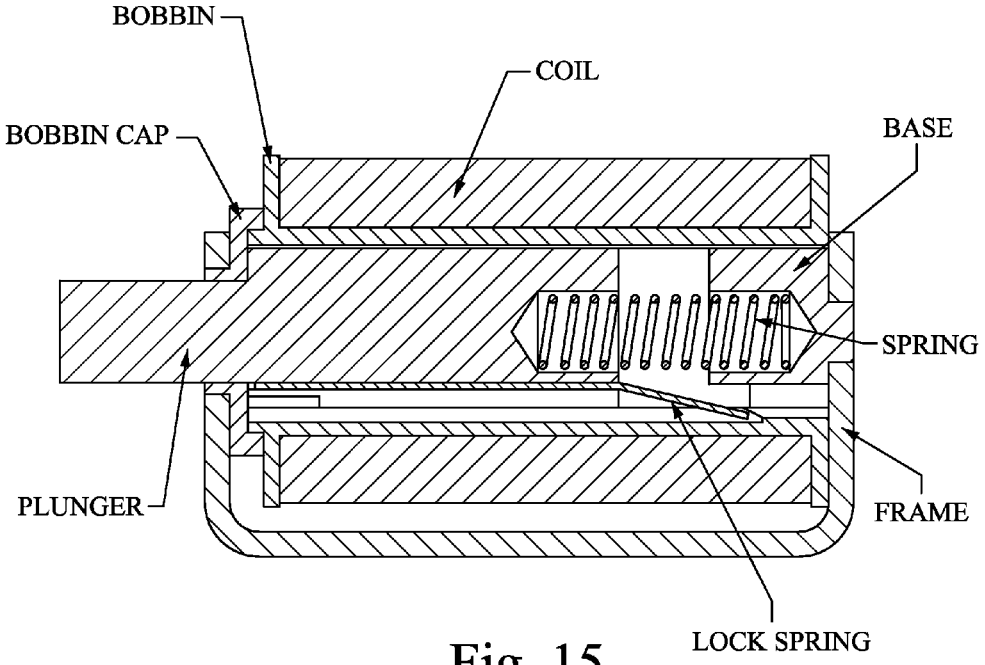
Fig. 15 (Prior Art)
FIG. 15 is a side sectioned view of a linear actuator according to a prior art embodiment.

The lock spring 32 of the technology disclosed herein facilitates a lower spring rate for return spring 30, e.g., a spring rate of about 0.2 lb/in, which is lower than a spring rate of about 0.9 lb/in for the prior art example of FIG. 15. This lower spring rate allows sufficient columnar stiffness (e.g., stiffness for distal end of spring lock spring 30 along plunger axis 34) to maintain the plunger 26 in its extended position (e.g., as shown in FIG. 1 or FIG. 9A). With the lower spring rate the lock spring 32 attracts to magnetic base 28 with much lower power levels, which in turn allows the return spring 30 to provide only a degree of biasing that is needed to return the plunger 26 to the plunger extended position. The linear actuator of the technology disclosed herein does not require a cushion or dampener between plunger and base, and thus may realize lower power requirement without having to have such a cushion or dampener.

In some example embodiments the lock spring 32 is separated from magnetic base 28 by a nonmagnetic bobbin feature, e.g., catch feature 70, so any frictional drag is minimized. Since the magnetic lock spring 32 is attracted to the magnetic base 28, and since the magnetic force rises exponentially, without the lock spring 32 being separated from magnetic base 28 by plunger receptacle 22, the lock spring 32 would have a high normal force to the magnetic base 28 and ferromagnetic-to-ferromagnetic contact would result with a high friction as the lock spring 32 slides with the plunger 26.

The linear actuator 20 of the technology disclosed herein does not employ a closing air gap construction. Instead, the magnetic base 28 is radially disposed to the plunger 26. The plunger 26 is magnetically attracted to the radially disposed magnetic base 28 until the point where force is reduced and motion ceases. Consequently, among the advantages of the technology disclosed herein are noise reduction, e.g., there is no noise resulting from impact as the technology disclosed herein does not have impact between plunger 26 and magnetic base 28. Moreover, with no metal-to-metal contact, there is no concern for residual magnetism. Also, as the force reduces, due to the magnetic circuit, the plunger assembly is slowly brought to a stop minimizing shock that would otherwise be associated with impacting a bumper or cushion.

Since return spring 30 is only required to return the plunger 26, the impact of the returning plunger 26 is minimized. The low return spring force translates to low energization power and low heat dissipation. Thus, usage of the lock spring 32 allows for a vibration-resistant locking, and the radially disposed magnetic base 28 allows for, e.g., lower required force levels and substantial elimination of metal-on-metal impact noise.

The technology disclosed herein thus provides for a quiet, mechanically shock resistant, bidirectional, low-power utilizing linear motion actuator which is locked against movement without the application of power. Advantages are thus a linear actuator which is quiet, requires low power, generates little heat, is mechanically shock resistant, and which is fail safe in the sense that it returns to a known position upon power failure.

While the actuator frame 50 has been shown essentially as having an open, L-shaped configuration, other configurations of frame 50 are possible. For example, the frame may be essentially cylindrical and encapsulate the coil assembly (e.g., plunger receptacle 22) in a situation in which the actuator serves a tubular shaped solenoid. In another example embodiment the frame 50 may have essentially a "D" shape wherein the frame extends over the top and bottom of the coil assembly.

In at least some example embodiments magnetic base 28 is not only outside the circumference of plunger 26, but also axially spaced (along axis 34) away from coil 24, so that the plunger 26 can be attracted to magnetic base 28. Other configurations are also possible. For example, the coil assembly may be stepped such that there may be a pocket for the base to protrude through the back end, such that at least a part of the base would be inside the coil assembly.

In some embodiments the lock spring has been illustrated as having one end connected to a plunger receptacle. It should be understood that "connected to" does not require a direct mounting on the plunger receptacle, since the lock spring may be connected through other or intermediate structure to the plunger receptacle. Moreover, in yet other embodiments the lock spring may be connected to structure other than the plunger receptacle, e.g., to the frame or even to the magnetic base.

Although the description above contains many specificities, these should not be construed as limiting the scope of the technology disclosed herein but as merely providing illustrations of some of the presently preferred embodiments of the technology disclosed herein. Thus the scope of the technology disclosed herein should be determined by the appended claims and their legal equivalents. Therefore, it will be appreciated that the scope of the technology disclosed herein fully encompasses other embodiments which may become obvious to those skilled in the art, and that the scope of the technology disclosed herein is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the technology disclosed herein, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A linear actuator comprising:

a plunger receptacle comprising a cavity at least partially formed by an interior surface of the plunger receptacle;

a coil wound about at least a portion of an exterior surface of the plunger receptacle;

a magnetic plunger at least partially disposed within the cavity for linear motion along a plunger axis;

a magnetic base radially disposed relative to the plunger;

a lock spring configured and oriented to lock the plunger in a plunger extended position but to be electromagnetically attracted to the magnetic base when the plunger moves to a plunger retracted position;

wherein the lock spring comprises a lock spring first end connected to the plunger and a lock spring second end, the lock spring second end being oriented to lock the plunger in the plunger extended position but to be attracted to the magnetic base and thereby permit movement of the plunger to the plunger retracted position.

2. The linear actuator of claim 1, further comprising a coil wound about at least a portion of an exterior surface of the plunger receptacle, and wherein the lock spring is configured and oriented to lock the plunger in the plunger extended position when power is not applied to the coil but to be attracted to the magnetic base and thereby permit movement of the plunger to the plunger retracted position when the power is applied to the coil.

3. The linear actuator of claim 1, wherein the magnetic base is disposed through an aperture formed in a cylindrical side wall of the plunger receptacle.

4. The linear actuator of claim 1, wherein the magnetic base is disposed through an aperture formed in an end wall of the plunger receptacle so that the magnetic base lies on a recessed interior surface of a cylindrical side wall of the plunger receptacle.

5. The linear actuator of claim 1, further comprising an actuator frame, the actuator frame comprising a frame aperture through which a plunger distal portion extends when the plunger is in the plunger extended position, and wherein the magnetic base serves to retain the plunger receptacle in position relative to the frame.

6. The linear actuator of claim 5, wherein a portion of the actuator frame is secured to the magnetic base.

7. The linear actuator of claim 1, wherein the magnetic base is disposed radially outside of an inner circumference of the plunger receptacle by an amount to reduce residual magnetism between the magnetic base and the lock spring.

8. A linear actuator comprising:

a plunger receptacle comprising a cavity at least partially formed by an interior surface of the plunger receptacle;

a coil wound about at least a portion of an exterior surface of the plunger receptacle;

a magnetic plunger at least partially disposed within the cavity for linear motion along a plunger axis;

a magnetic base radially disposed relative to the plunger;

a lock spring configured and oriented to lock the plunger in a plunger extended position but to be attached to the magnetic base when the plunger moves to a plunger retracted position;

wherein the lock spring comprises a lock spring first end connected to the plunger and a lock spring second end, the lock spring second end being oriented to lock the plunger in the plunger extended position but to be attracted to the magnetic base and thereby permit movement of the plunger to the plunger retracted position.

9. The linear actuator of claim 8, further comprising a return spring disposed to bias the plunger to the plunger extended position.

10. The linear actuator of claim 9, wherein the plunger receptacle comprises a plunger receptacle end wall, wherein a first end of the return spring contacts the plunger receptacle end wall and a second end of the return spring bears against the plunger; and wherein the plunger receptacle end wall comprises a catch feature which engages the lock spring second end.

11. The linear actuator of claim 10, wherein catch feature comprises a beveled surface which engages the lock spring second end.

12. The linear actuator of claim 10, wherein the plunger receptacle end wall comprises an aperture configured to accommodate the lock spring second end when the lock spring second end is attracted to the magnetic base.

13. A linear actuator comprising:

a plunger receptacle comprising a cavity at least partially formed by an interior surface of the plunger receptacle;

a coil wound about at least a portion of an exterior surface of the plunger receptacle;

a magnetic plunger at least partially disposed within the cavity for linear motion along a plunger axis;

a magnetic base radially disposed relative to the plunger;

a lock spring which is accommodated within the plunger receptacle and which is configured and oriented to lock the plunger in a plunger extended position but to be attracted to the magnetic base when the plunger moves to a plunger retracted position;

wherein the lock spring comprises a lock spring first end connected to the plunger and a lock spring second end, the lock spring second end being oriented to lock the plunger in the plunger extended position but to be attracted to the magnetic base and thereby permit movement of the plunger to the plunger retracted position.

14. The linear actuator of claim 13, wherein the lock spring is accommodated radially between the magnetic base and the plunger axis.

* * * * *